US011066734B2

(12) United States Patent
Ibe et al.

(10) Patent No.: US 11,066,734 B2
(45) **Date of Patent: *Jul. 20, 2021**

(54) THERMAL SPRAY SLURRY, THERMAL SPRAY COATING AND METHOD FOR FORMING THERMAL SPRAY COATING

(71) Applicant: FUJIMI INCORPORATED, Kiyosu (JP)

(72) Inventors: Hiroyuki Ibe, Kiyosu (JP); Fumi Shinoda, Kiyosu (JP); Kazuyuki Tsuzuki, Kiyosu (JP)

(73) Assignee: FUJIMI INCORPORATED, Kiyosu (JP)

( * ) Notice: Subject to any disclaimer, the term of this patent is extended or adjusted under 35 U.S.C. 154(b) by 460 days.

This patent is subject to a terminal disclaimer.

(21) Appl. No.: 15/508,261

(22) PCT Filed: Sep. 3, 2015

(86) PCT No.: PCT/JP2015/075139

§ 371 (c)(1),
(2) Date: Mar. 2, 2017

(87) PCT Pub. No.: WO2016/035870

PCT Pub. Date: Mar. 10, 2016

(65) Prior Publication Data

US 2017/0283933 A1 Oct. 5, 2017

(30) Foreign Application Priority Data

Sep. 3, 2014 (JP) ..... JP2014-178710

(51) Int. Cl.

| | |
|---|---|
| ***C23C 4/08*** | (2016.01) |
| ***C23C 4/10*** | (2016.01) |
| ***C23C 4/06*** | (2016.01) |
| ***C23C 4/12*** | (2016.01) |
| ***C23C 4/134*** | (2016.01) |
| ***C23C 4/129*** | (2016.01) |

(52) U.S. Cl.

CPC ..... *C23C 4/134* (2016.01); *C23C 4/06* (2013.01); *C23C 4/08* (2013.01); *C23C 4/10* (2013.01); *C23C 4/12* (2013.01); *C23C 4/129* (2016.01)

(58) Field of Classification Search

None

See application file for complete search history.

(56) References Cited

U.S. PATENT DOCUMENTS

| | | | | |
|---|---|---|---|---|
| 4,450,184 | A | 5/1984 | Longo et al. | |
| 4,741,838 | A | 5/1988 | Sharpe, Jr. | |
| 4,755,492 | A | 7/1988 | Greskovich et al. | |
| 4,884,788 | A | 12/1989 | Shaffer | |
| 5,433,901 | A | 7/1995 | Rancoule et al. | |
| 6,469,226 | B1 | 10/2002 | Chica Lara et al. | |
| 7,115,832 | B1 | 10/2006 | Blankenship et al. | |
| 7,250,080 | B1 | 7/2007 | Craig et al. | |
| 10,196,729 | B2 | 2/2019 | Ibe et al. | |
| 2002/0018902 | A1* | 2/2002 | Tsukatani | C23C 4/11 428/469 |
| 2002/0160189 | A1 | 10/2002 | Wataya et al. | |
| 2002/0177014 | A1 | 11/2002 | Kaneyoshi et al. | |
| 2003/0136467 | A1 | 7/2003 | Hiratsu et al. | |
| 2004/0126566 | A1* | 7/2004 | Axen | A61L 27/32 428/323 |
| 2004/0197580 | A1 | 10/2004 | Dorfman et al. | |
| 2004/0221516 | A1 | 11/2004 | Cho et al. | |
| 2006/0091119 | A1 | 5/2006 | Zajchowski et al. | |
| 2006/0093748 | A1 | 5/2006 | Zajchowski et al. | |
| 2006/0110320 | A1 | 5/2006 | Aoki et al. | |
| 2006/0121068 | A1 | 6/2006 | Sane et al. | |
| 2006/0151321 | A1 | 7/2006 | Itoh et al. | |
| 2007/0023402 | A1 | 2/2007 | Zajchowski et al. | |
| 2007/0087129 | A1 | 4/2007 | Blankenship et al. | |
| 2007/0094936 | A1 | 5/2007 | Cho et al. | |
| 2009/0208662 | A1 | 8/2009 | Blankenship et al. | |
| 2009/0314202 | A1 | 12/2009 | Zajchowski et al. | |
| 2010/0199494 | A1 | 8/2010 | Zajchowski et al. | |

(Continued)

FOREIGN PATENT DOCUMENTS

| | | |
|---|---|---|
| EP | 1 167 565 A2 | 1/2002 |
| EP | 1 652 953 A1 | 5/2006 |

(Continued)

OTHER PUBLICATIONS

European Search Report dated Mar. 1, 2017 issued in EP Application No. 16194314.7.

Taiwanese Office Action issued in application No. 103108410 dated Aug. 11, 2017.

U.S. Office Action issued in co-pending U.S. Appl. No. 14/773,863 dated Feb. 16, 2018.

U.S. Office Action issued in co-pending U.S. Appl. No. 14/773,863 dated Apr. 21, 2017.

U.S. Office Action issued in co-pending U.S. Appl. No. 14/773,863 dated Sep. 25, 2017.

U.S. Office Action issued in co-pending U.S. Appl. No. 14/773,874 dated Aug. 25, 2017.

U.S. Office Action issued in co-pending U.S. Appl. No. 14/773,874 dated Dec. 20, 2016.

(Continued)

*Primary Examiner* — Sheeba Ahmed

(74) *Attorney, Agent, or Firm* — Foley & Lardner LLP

(57) ABSTRACT

This invention provides a thermal spray slurry capable of forming a favorable thermal spray coating. The thermal spray slurry comprises a dispersion medium and thermal spray particles formed of at least one material selected from the group consisting of a ceramic, a cermet and a metal. 800 mL of the thermal spray slurry contains A kg of the thermal spray particles; when 800 mL of the thermal spray slurry in which the thermal spray particles are dispersed is supplied at a flow rate of 35 mL/min to a horizontally-placed tube and collected, the collected slurry contains B kg of the thermal spray particles; and the slurry has a supply efficiency index If of 70% or higher, determined by the next equation If (%)=B/A×100.

8 Claims, No Drawings

(56) References Cited

U.S. PATENT DOCUMENTS

| | | | | |
|---|---|---|---|---|
| 2010/0330282 | A1 | 12/2010 | Nienburg et al. | |
| 2011/0086178 | A1 | 4/2011 | Ruud et al. | |
| 2011/0123431 | A1 | 5/2011 | Toma et al. | |
| 2011/0237421 | A1 | 9/2011 | Burgess et al. | |
| 2013/0040801 | A1 | 2/2013 | Schrems et al. | |
| 2013/0068729 | A1 | 3/2013 | Zajchowski et al. | |
| 2013/0098879 | A1 | 4/2013 | Zajchowski et al. | |
| 2014/0178641 | A1 | 6/2014 | Leblanc et al. | |
| 2014/0360407 | A1 | 12/2014 | Kitamura et al. | |
| 2015/0096462 | A1 | 4/2015 | Fukagawa et al. | |
| 2015/0307715 | A1 | 10/2015 | Sato et al. | |
| 2015/0321964 | A1 | 11/2015 | Sun et al. | |
| 2016/0024328 | A1* | 1/2016 | Kitamura | C08K 5/05 106/287.17 |
| 2016/0040278 | A1 | 2/2016 | Kitamura et al. | |
| 2017/0088930 | A1 | 3/2017 | Ibe et al. | |
| 2017/0283933 | A1 | 10/2017 | Ibe et al. | |

FOREIGN PATENT DOCUMENTS

| | | | |
|---|---|---|---|
| EP | 2 868 766 | A1 | 5/2015 |
| JP | 58-151474 | A | 9/1983 |
| JP | 60-149403 | A | 8/1985 |
| JP | H01-316258 | A | 12/1989 |
| JP | 02-097459 | A | 4/1990 |
| JP | 08-104969 | A | 4/1996 |
| JP | 10-088311 | A | 4/1998 |
| JP | 10-298732 | A | 11/1998 |
| JP | 2002-080954 | A | 3/2002 |
| JP | 2004-331852 | A | 11/2004 |
| JP | 2005-002446 | A | 1/2005 |
| JP | 2006-131997 | A | 5/2006 |
| JP | 2006-144094 | A | 6/2006 |
| JP | 3892300 | B2 | 3/2007 |
| JP | 2009-161789 | A | 7/2009 |
| JP | 2010-150617 | A | 7/2010 |
| JP | 2010-218759 | A | 9/2010 |
| JP | 2011-088037 | A | 5/2011 |
| JP | 2011-522115 | A | 7/2011 |
| JP | 2011-168456 | A | 9/2011 |
| JP | 2011-524944 | A | 9/2011 |
| JP | 2013-136814 | A | 7/2013 |
| JP | 2014-083110 | A | 5/2014 |
| JP | 2014-122418 | A | 7/2014 |
| JP | 2014-240511 | A | 12/2014 |
| WO | WO-97/18341 | A1 | 5/1997 |
| WO | WO-02/40182 | A1 | 5/2002 |
| WO | WO-2008/036887 | A2 | 3/2008 |
| WO | WO-2009/143626 | A1 | 12/2009 |
| WO | WO-2013/099890 | A1 | 7/2013 |
| WO | WO-2014-002580 | A1 | 1/2014 |
| WO | WO-2014/142017 | A1 | 9/2014 |
| WO | WO-2014/142018 | A1 | 9/2014 |
| WO | WO-2015/019673 | A1 | 2/2015 |
| WO | WO-2015-185651 | A1 | 12/2015 |
| WO | WO-2016/043754 | A1 | 3/2016 |

OTHER PUBLICATIONS

U.S. Office Action issued in co-pending U.S. Appl. No. 14/773,874 dated Apr. 3, 2017.
U.S. Office Action issued in co-pending U.S. Appl. No. 15/258,131 dated Oct. 12, 2017.
U.S. Office Action issued in co-pending U.S. Appl. No. 15/297,464 dated Dec. 6, 2017.
Non Final Office Action dated Oct. 31, 2018 in corresponding U.S. Appl. No. 15/297,464.
Final Office Action on U.S. Appl. No. 15/297,464 dated Jul. 23, 2018.
Non-Final Office Action on U.S. Appl. No. 15/258,131 dated Sep. 4, 2018.
Notice of Allowance on U.S. Appl. No. 14/773,874 dated Sep. 17, 2018.
Notice of Allowance on U.S. Appl. No. 15/258,118 dated Sep. 19, 2018.
Final Office Action on U.S. Appl. No. 14/773,863 dated Jul. 25, 2018.
Ibe et al.: U.S. Office Action on U.S. Appl. No. 15/258118 dated Apr. 30, 2018.
Kitamura et al.: U.S. Office Action on U.S. Appl. No. 14/773,874 dated Mar. 19, 2018.
Final Office Action on U.S. Appl. No. 15/297,464 dated May 10, 2019.
Office Action in European application No. 16194314.7 dated Feb. 13, 2019.
Non Final Office Action dated Dec. 18, 2018 in U.S. Appl. No. 14/773,863.
English Translation of a Japanese Office Action dated Mar. 28, 2017 in application No. 2015-505436.
Korean Office Action issued in application No. 10-2015-702727 dated Nov. 16, 2017.
Machine translation of JP 2011-168456, published Sep. 1, 2011.
Ibe et al.: U.S. Office Action on U.S. Appl. No. 15/258,131 dated Apr. 24, 2018.
Notice of Allowance on U.S. Appl. No. 14/773,874 dated Oct. 26, 2018.
Summons to Attend Oral Proceedings Pursuant to Rule 115(1) EPC issued in corresponding European application No. 15839034.4 dated Sep. 18, 2020.
Decision to Refuse a European Patent Application issued in corresponding European Patent Application No. 15839034.4 dated Mar. 1, 2021.

* cited by examiner

THERMAL SPRAY SLURRY, THERMAL SPRAY COATING AND METHOD FOR FORMING THERMAL SPRAY COATING

TECHNICAL FIELD

The present invention relates to a thermal spray slurry comprising thermal spray particles, a thermal spray coating formed with the thermal spray slurry and a method for forming the thermal spray coating.

The present application claims priority to Japanese Patent Application No. 2014-178710 filed on Sep. 3, 2014; the entire content thereof is incorporated herein by reference.

BACKGROUND ART

Heretofore, various fields have taken advantage of technologies to coat substrate surfaces with various materials to provide novel functionalities. As one of the surface-coating technologies, for instance, thermal spraying is known in which substrate surfaces are sprayed with thermal spray particles formed of materials such as ceramic, cermets and metals softened or melted by combustion energy or by electric energy, whereby thermal spray coatings are formed from these materials.

In the thermal spraying, usually, thermal spray particles as the coating material are supplied in a powder form to thermal sprayers. Lately, dispersions of thermal spray particles in dispersion media are also supplied as slurries (including suspensions) to thermal sprayers. As for conventional technologies related to the thermal spray slurries, for instance, Patent Document 1 is cited.

CITATION LIST

Patent Literature

[Patent Document 1] Japanese Patent Application Publication No. 2010-150617

SUMMARY OF INVENTION

Technical Problem

In a thermal spray slurry, precipitation of thermal spray particles may occur during the storage of the slurry, due to a difference in specific gravity between the thermal spray particles and the dispersion medium or due to the influence of the particle diameters of the thermal spray particles. Precipitated thermal spray particles are no longer fluid. Thus, thermal spray slurries that easily precipitate are not suited as thermal spray materials. With increasing precipitation of thermal spray particles, less thermal spray particles may be supplied or clogging may occur in the supply system.

Under these circumstances, the present inventors have conducted various studies and, as a result, reached a finding that even with a thermal spray slurry in which precipitation can occur, if the thermal spray particles can be supplied in a form suited to thermal spraying, a high-quality thermal spray coating can be formed, making the slurry favorable as a thermal spray material. This invention has been made based on this finding with an objective to provide a thermal spray slurry capable of forming a favorable thermal spray coating. Another objective is to provide a thermal spray coating formed with this thermal spray slurry and a method for forming a thermal spray coating.

Solution to Problem

To solve the problem, the present invention provides a thermal spray slurry having the following features. The thermal spray slurry comprises a dispersion medium and thermal spray particles formed of at least one material selected from the group consisting of a ceramic, a cermet and a metal. 800 mL of the thermal spray slurry contains A kg of the thermal spray particles. When 800 mL of the thermal spray slurry in which the thermal spray particles are dispersed is supplied at a flow rate of 35 mL/min to a horizontally-placed tube and collected, the collected slurry contains B kg of the thermal spray particles. The slurry is characterized by having a supply efficiency index If of 70% or higher, determined by the next equation If (%)=B/A×100.

In such an embodiment, the efficiency of supplying the slurry to a thermal sprayer can be assessed, taking into account the dispersibility, fluidity, etc., of the thermal spray particles in the thermal spray slurry. In a thermal spray slurry with a supply efficiency index If of 70% or higher, precipitation of the particles is reduced and the slurry is considered to have great supply efficiency to the thermal sprayer. By this, even if the thermal spray slurry precipitates during long term storage, precipitation and solidification of the thermal spray particles are reduced and the thermal spray slurry can be stably supplied in a favorably dispersed or fluid state to a thermal sprayer.

In a preferable embodiment, the thermal spray slurry disclosed herein is characterized by further comprising a dispersing agent. In this embodiment, the dispersion stability of the thermal spray particles in the slurry increases, whereby the thermal spray slurry is provided with increased supply efficiency.

In a preferable embodiment, the thermal spray slurry disclosed herein is characterized by that the thermal spray particle content is 10% by weight or higher, but 50% by weight or lower. In such an embodiment, the thermal spray slurry is provided, comprising the thermal spray particles in a suitable concentration, yet with favorably reduced precipitation of the thermal spray particles.

In a preferable embodiment of the thermal spray slurry disclosed herein, the thermal spray particles are characterized by having an average particle diameter of 0.01 μm or larger, but 10 μm or smaller. In such an embodiment, the thermal spray slurry is provided with favorably reduced precipitation of the thermal spray particles.

In this description, with respect to thermal spray particles having an average particle diameter smaller than 1 μm, the average particle diameter is the average particle diameter (equivalent spherical diameter) determined based on the specific surface area. The average particle diameter D is the value obtained based on the next equation $D=6/(\rho \cdot S)$ with S being the specific surface area of the thermal spray particles and p being the density of the material forming the thermal spray particles. For instance, when the thermal spray particles are of yttria (yttrium oxide ($Y_2O_3$)), D can be determined with the density ρ being 5.01 g/cm$^3$. For the specific surface area of the thermal spray particles, the value obtained by gas adsorption can be used. The specific surface area can be measured based on "Determination of the specific surface area of powders (solids) by gas adsorption-BET method" in JIS Z 8830:2013 (ISO 9277:2010). For instance, the specific surface area of the thermal spray particles can be measured, using a dynamic flow surface area analyzer FLOWSORB II 2300 available from Micromeritics.

With respect to thermal spray particles having an average particle diameter of 1 μm or larger, the average particle diameter is the 50th percentile particle diameter (volume median particle diameter) in the size distribution by volume measured with a particle size analyzer based on laser diffraction/scattering spectroscopy. As an ordinarily skilled person would understand, the boundary value (1 μm) at which this measurement method should be applied is not necessarily strict. For instance, depending on the resolution of the analyzer used, etc., when the thermal spray particles have particle diameters in the vicinity of 1 μm, the average particle diameter can be obtained based on laser diffraction/scattering spectroscopy.

In a preferable embodiment, the thermal spray slurry disclosed herein is characterized by having a viscosity of 1000 MPa·s or lower. Such an embodiment reduces precipitation of the thermal spray particles and the thermal spray slurry is provided with favorable fluidity.

In this description, the viscosity of the thermal spray slurry is measured at room temperature (25° C.) using a rotational viscometer. For the viscosity, for instance, the value measured using a model B viscometer (e.g. VISCOTESTER VT-03F available from Rion Co., Ltd.) can be used.

In a preferable embodiment of the thermal spray slurry disclosed herein, the dispersion medium is characterized by being an aqueous dispersion medium. Such an embodiment reduces or eliminates the use of organic solvents, whereby the thermal spray material with less environmental impact is provided. As compared to an embodiment using a non-aqueous dispersion medium, the use of an aqueous dispersion medium is beneficial in view that the resulting thermal spray coating will have a smooth surface with reduced surface roughness.

In a preferable embodiment of the thermal spray slurry disclosed herein, the dispersion medium is characterized by being a non-aqueous dispersion medium. Such an embodiment provides a thermal spray material that allows thermal spraying at a lower temperature. As compared to an embodiment using an aqueous dispersion medium, the use of a non-aqueous dispersion medium is beneficial in view that the resulting thermal spray coating has a lower porosity.

In another aspect, the present invention provides a thermal spray coating obtained by thermal spraying an aforementioned thermal spray slurry. For instance, the thermal spray coating may be formed by highly efficient thermal spraying of thermal spray particles with a relatively small average particle diameter. Thus, it can be formed as a dense, tightly adhered, highly strong thermal spray coating.

In another aspect, the art disclosed herein provides a method for forming a thermal spray coating. The method is characterized by forming the thermal spray coating by subjecting an aforementioned thermal spray slurry to thermal spraying. According to such an embodiment, for instance, thermal spray particles with a relatively small average particle diameter can be supplied highly efficiently with great fluidity to a thermal sprayer and to a thermal spray flame. For instance, a dense, tightly adhered, highly strong thermal spray coating can be formed.

In a preferable embodiment, the thermal spray coating method disclosed herein is characterized by supplying the thermal spray slurry to a thermal sprayer at a flow rate of 10 mL/min or higher, but 200 mL or lower. For instance, such an embodiment can bring about a hard flow (flow field) of the thermal spray slurry being transported through a supply device, whereby the thermal spray slurry and further the thermal spray particles can be efficiently transported.

In a preferable embodiment, the thermal spray coating method disclosed herein is characterized by forming the thermal spray coating by subjecting the thermal spray slurry to high velocity flame spraying or plasma spraying. The dispersion medium of the thermal spray slurry can be either an aqueous solvent or a non-aqueous solvent. Thus, a thermal spray method suited to bring about desirable coating properties can be employed to form the thermal spray coating.

In a preferable embodiment, the thermal spray coating method disclosed herein is characterized by supplying the thermal spray slurry to a thermal sprayer in an axial feed mode. Such an embodiment is preferable because the thermal spray particles in the slurry are fed in the axial direction to the heat source for thermal spraying and more thermal spray particles can contribute to formation of the coating, leading to highly efficient formation of the thermal spray coating.

The axial feed system is a technique in which a thermal spray slurry is supplied from the center of a heat source (e.g. a plasma arc, a burning flame) for thermal spraying in the jet direction of the heat source or in the axial direction of a torch nozzle.

In a preferable embodiment, the thermal spray coating method disclosed herein is characterized by supplying the thermal spray slurry to a thermal sprayer using two feeders, with the two feeders supplying the thermal spray slurry in amounts (at rates) changing in oppositely-phased cycles. Such an embodiment further reduces aggregation and precipitation of a thermal spray material with a relatively large average particle diameter, whereby the slurry can be supplied at an approximately constant rate without irregularities. This can preferably form a thermal spray coating with a more even network.

In a preferable embodiment, the thermal spray coating method disclosed herein is characterized by releasing the thermal spray slurry from the feeders, temporarily storing it in a tank placed right before the thermal sprayer and supplying the thermal spray slurry to the thermal sprayer by allowing the slurry to naturally fall.

In such an embodiment, the state of the thermal spray slurry can be made ready in the tank placed right before the thermal sprayer, and aggregation and precipitation of the thermal spray material with a relatively large average particle diameter can be reduced, whereby the thermal spray slurry can be supplied at an approximately constant rate without irregularities. By this, a thermal spray coating with a more even network can be formed as well.

In a preferable embodiment, the thermal spray coating method disclosed herein is characterized by supplying the thermal spray slurry through a conductive tube to the thermal sprayer. Such an embodiment is preferable because it inhibits the generation of static charges in the thermal spray slurry flowing through the conductive tube and the supply amount of the thermal spray particles is less likely to change.

In another aspect, the art disclosed herein provides a thermal spray slurry prep material (or simply a "prep material" hereinafter) for use in preparing a thermal spray slurry. The thermal spray slurry comprises a dispersion medium and thermal spray particles formed of at least one species of material selected from the group consisting of a ceramic, a cermet and a metal. 800 mL of the thermal spray slurry contains A kg of the thermal spray particles. When 800 mL of the thermal spray slurry in which the thermal spray particles are dispersed is supplied at a flow rate of 35 mL/min to a horizontally-placed tube and collected, the collected slurry contains B kg of the thermal spray particles. The slurry is characterized by having a supply efficiency index If of 70% or higher, determined by the next equation If (%)=B/A×100. The slurry prep material disclosed herein is characterized by comprising at least one component of the thermal spray slurry.

With respect to the thermal spray slurry, even if it comprises a component that may precipitate out, precipitation and solidification are reduced. Thus, for instance, even if the components of the thermal spray slurry are divided into several units (e.g. separately packed), they can be mixed to favorably and easily prepare the thermal spray slurry. When the thermal spray slurry is divided in several units, the storage stability preferably increases, saving storage spaces and facilitating the transport.

In a preferable embodiment, the prep material disclosed herein is characterized by further comprising information regarding preparation of the thermal spray slurry. By this, the thermal spray slurry can be suitably prepared even when the prep material is part of the components of the thermal spray slurry.

In a preferable embodiment of the prep material disclosed herein, the at least one component may comprise the thermal spray particles. Alternatively, the at least one component may comprise the thermal spray particles and at least a portion of the dispersion medium. The prep material may further comprise a dispersing agent. In other words, the prep material disclosed herein can be provided in various embodiments according to users' needs.

DESCRIPTION OF EMBODIMENTS

Preferred embodiments of the present invention are described below. Matters necessary to practice this invention other than those specifically referred to in this description may be understood as design matters based on the conventional art in the pertinent field by a person of ordinary skill in the art. The present invention can be practiced based on the contents disclosed in this description and common technical knowledge in the subject field.

[Thermal Spray Slurry]

The thermal spray slurry disclosed herein basically comprises a dispersion medium and thermal spray particles formed of at least one species of material selected from the group consisting of a ceramic, a cermet and a metal. It is characterized by having a supply efficiency index If of 70% or higher; the index is defined as below.

<Determination of Supply Efficiency Index If>

(1) 800 mL of the thermal spray slurry contains A kg of thermal spray particles.

(2) When 800 mL of the thermal spray slurry in which the thermal spray particles are dispersed is supplied at a flow rate of 35 mL/min to a horizontally-placed tube and collected, the collected slurry contains B kg of the thermal spray particles.

(3) Based on A and B above, the supply efficiency index If is the value determined by the next equation If (%)=B/A×100.

(Thermal Spray Particles)

The thermal spray slurry disclosed herein can comprise thermal spray particles formed of at least one species of material selected from the group consisting of a ceramic, a cermet and a metal.

Here, the ceramic is not particularly limited. Examples include oxide-based ceramics formed of oxides of various metals, carbide-based ceramics formed of metal carbides, and nitride-based ceramics formed of metal nitrides as well as other non-oxide-based ceramics formed of non-oxides such as borides, fluorides, hydroxides, carbonates and phosphates of metals.

The oxide-based ceramic is not particularly limited and can be various metal oxides. The metal(s) forming the oxide-based ceramic can be, for example, one, two or more species selected among metalloids such as B, Si, Ge, Sb, and Bi; typical elements such as Na, Mg, Ca, Sr, Ba, Zn, Al, Ga, In, Sn, Pb, and P; transition metals such as Sc, Y, Ti, Zr, Hf, V, Nb, Ta, Cr, Mo, W, Mn, Fe, Co, Ni, Cu, Ag, and Au; and lanthanoids such as La, Ce, Pr, Nd, Pm, Sm, Eu, Gd, Td, Dy, Ho, Er, Tu, Tb, and Lu. In particular, one, two or more species selected among Mg, Y, Ti, Zr, Cr, Mn, Fe, Zn, Al, and Er are preferable. The oxide-based ceramic disclosed herein preferably comprises also a halogen atom such as F, Cl, Br and I in addition to the metals.

More specific examples of the oxide-based ceramic include alumina, zirconia, yttria, chromia, titania, cobaltite, magnesia, silica, calcia, ceria, ferrite, spinel, zircon, forsterite, steatite, cordierite, mullite, nickel oxide, silver oxide, copper oxide, zinc oxide, gallium oxide, strontium oxide, scandium oxide, samarium oxide, bismuth oxide, lanthanum oxide, lutetium oxide, hafnium oxide, vanadium oxide, niobium oxide, tungsten oxide, manganese oxide, tantalum oxide, terbium oxide, europium oxide, neodymium oxide, tin oxide, antimony oxide, antimony-containing tin oxide, indium oxide, barium titanate, lead titanate, lead zirconate titanate, Mn—Zn ferrite, Ni—Zn ferrite, sialon, tin-containing indium oxide, zirconium oxide aluminate, zirconium oxide silicate, hafnium oxide aluminate, hafnium oxide silicate, titanium oxide silicate, lanthanum oxide silicate, lanthanum oxide aluminate, yttrium oxide silicate, titanium oxide silicate, tantalum oxide silicate, yttrium oxyfluoride, yttrium oxychloride, yttrium oxybromide, and yttrium oxyiodide.

Examples of the non-oxide-based ceramic include carbide-based ceramic such as tungsten carbide, chromium carbide, niobium carbide, vanadium carbide, tantalum carbide, titanium carbide, zirconium carbide, hafnium carbide, silicon carbide, and boron carbide; nitride-based ceramic such as silicon nitride, and aluminum nitride; boride-based ceramic such as hafnium boride, zirconium boride, tantalum boride, and titanium boride; hydroxy-based ceramic such as hydroxyapatite; and phosphate-based ceramic such as calcium phosphate.

The metal is not particularly limited. Examples include the various elemental metals listed as the components of the ceramic as well as alloys formed of these elements and one or more other elements. Typical examples of the elemental metals include nickel, copper, aluminum, iron, chromium, niobium, molybdenum, tin and lead. The alloy includes nickel-based alloys, chromium-based alloys, copper-based alloys, and steel. The alloy referred to herein encompasses a substance that is formed of an aforementioned metal and at least one other element and exhibits metallic characteristics; they can be mixed as a solid solution, intermetallic compound, or a mixture of these.

The cermet is not particularly limited and includes general composite materials in which ceramic particles are bonded in a metal matrix. The cermet can be, for instance, a composite of aforementioned ceramic and metal. More specifically, typical examples include composites (cermets) of a titanium compound (e.g. titanium carbide (TiC), titanium carbo-nitride (TiCN), etc.), a carbide-based ceramic (e.g. tungsten carbide (WC), chromium carbide (CrC), etc.) or an oxide-based ceramic (e.g. alumina ($Al_2O_3$)) with a metal such as iron (Fe), chromium (Cr), molybdenum (Mo), nickel (Ni), etc. Such a cermet can be obtained, for instance, by calcining desirable ceramic particles and metal particles under a suitable atmosphere.

To increase the functionalities, etc., the material forming the thermal spray particles may include an element other than those exemplified above. The ceramic, cermet or metal can be individually a mixture or a composite of two or more ceramics, cermet or metals that have different compositions. It can be a mixture of two or more species among the ceramics, cermets and metals.

The thermal spray particles are not particularly limited as long as the average particle diameter is about 30 μm or smaller. The minimum average particle diameter is not particularly limited, either. Here, it is preferable to use thermal spray particles with a relatively small average particle diameter as the thermal spray slurry disclosed herein because the effect to increase the supply efficiency will be evident. From such a standpoint, the average particle diameter of the thermal spray particles can be, for instance, 10 μm or smaller, preferably 8 μm or smaller, or more preferably 5 μm or smaller, for example, 1 μm or smaller. With respect to the minimum average particle diameter, in view of the viscosity and fluidity of the thermal spray slurry, for instance, it can be 0.01 μm or larger, preferably 0.05 μm or larger, or more preferably 0.1 μm or larger, for example, 0.5 μm or larger.

Usually, when fine thermal spray particles having an average particle diameter of, for instance, about 10 μm or smaller are used as a thermal spray material, the fluidity may decrease with increasing specific surface area. Such a thermal spray material may show poor supply efficiency to a thermal sprayer, making its supply to the thermal sprayer difficult due to accumulation of the thermal spray material in the supply path, etc., resulting in a reduced capability to form coatings. Because of the small mass, such a thermal spray material may be blown off by a thermal spray flame or a jet stream and its suitable travel through the air may be impeded. On the other hand, with respect to the thermal spray slurry disclosed herein, even if the thermal spray particles have an average particle diameter of, for instance, 10 μm or smaller, because of the preparation as a slurry that takes into account the supply efficiency to thermal sprayers, accumulation of the particles in the supply path, etc., can be reduced and the coating capability can be maintained at a high level. Since it is supplied as a slurry to a flame or to a jet stream, it can be carried by the flow without getting blown off by the flame or the jet stream. In addition, because the dispersion medium is removed during the travel, a thermal spray coating can be formed while maintaining the thermal spray efficiency at a higher level.

Although the thermal spray particles are not necessarily limited to the following, too large a specific surface area is not preferable because the viscosity of the thermal spray slurry becomes excessively high, leading to poor supply efficiency. The specific surface area of the thermal spray particles is preferably 50 $m^2/g$ or smaller, more preferably 40 $m^2/g$ or smaller, or particularly preferably 30 $m^2/g$ or smaller (e.g. 20 $m^2/g$ or smaller, or even 10 $m^2/g$ or smaller). Too small a specific surface area may be favorable in view of the low viscosity of the thermal spray slurry; however, it is not preferable because the specific gravity of the material forming the thermal spray particles has more impact and solid-liquid separation is likely to occur. Thus, while the minimum specific surface area is not strictly limited, it can be, for instance, 0.1 $m^2/g$ or above. For the specific surface area, the value determined by a gas adsorption method can be used. As described earlier, the specific surface area can be determined based on "Determination of the specific surface area of powders (solids) by gas adsorption-BET method" in JIS Z 8830:2013 (ISO 9277:2010). For instance, the specific surface area of thermal spray particles can be determined using a dynamic flow surface area analyzer FLOWSORB II 2300 available from Micromeritics.

(Dispersion Medium)

The thermal spray slurry disclosed herein can comprise an aqueous or non-aqueous dispersion medium.

The aqueous dispersion medium can be water or a mixture (an aqueous solvent mixture) of water and a water-soluble organic solvent. As the water, tap water, ion-exchanged water (deionized water), distilled water, pure water and the like can be used. As the non-aqueous organic solvent forming the aqueous solvent mixture, one, two or more species can be suitably selected and used among organic solvents (e.g. lower alcohols, lower ketones, etc., with one to four carbons) that can homogeneously mix with water. As the aqueous solvent, it is preferable to use a solvent mixture with, for instance, 80% or more water (more preferably 90% or more water, or yet more preferably 95% or more water) by mass. A particularly preferable example is an aqueous solvent essentially consisting of water (e.g. tap water, distilled water, pure water, purified water).

The non-aqueous solvent is typically an organic solvent that does not contain water (e.g. that cannot be diluted with water). The organic solvent is not particularly limited. For example, solely one species or a combination of two or more species can be used among organic solvents such as alcohols including methanol, ethanol, n-propanol, and isopropanol as well as toluene, hexane, kerosene and the like.

The species and composition of the dispersion medium used can be suitably selected in accordance with, for instance, the thermal spray method for the slurry. In other words, for instance, when the thermal spray slurry is subjected to high velocity flame spraying, either an aqueous or a non-aqueous solvent can be used. It is beneficial to use an aqueous dispersion medium in view that the resulting thermal spray coating will have improved surface roughness (will have a smooth surface). It is advantageous to use a non-aqueous dispersion medium in view that the porosity of the resulting thermal spray coating will be lower than when an aqueous dispersion medium is used.

(Dispersing Agent)

The thermal spray slurry disclosed herein may further comprise a dispersing agent as necessary Here, the dispersion medium generally refers to a compound of the thermal spray slurry that can increase the dispersion stability of the thermal spray particles in the dispersion medium. The dispersing agent can be basically, for instance, a compound that acts on the thermal spray particles or a compound that acts on the dispersion medium. For instance, it can be a compound to improve the surface wettability of the thermal spray particles, a compound that peptizes the thermal spray particles, or a compound that inhibits or hinder re-aggregation of peptized thermal spray particles, with the compound acting on the thermal spray particles or on the dispersion medium.

For the dispersing agent, in accordance with the dispersion medium, a suitable species can be selected and used among aqueous dispersing agents and non-aqueous dispersing agents. The dispersing agent can be a polymeric dispersing agent, a surfactant-based dispersing agent (or a low molecular weight dispersing agent), or an inorganic dispersing agent. These can be anionic, cationic, or nonionic. In other words, the molecular structure of the dispersing agent may have at least one functional group among anionic groups, cationic groups and nonionic groups.

Examples of the polymeric dispersing agent include, as for the aqueous dispersing agent, dispersing agents formed of polycarboxylic acid-based compounds such as sodium polycarboxylate, ammonium polycarboxylate, and polycarboxylic acid-based polymers; dispersing agents formed of sodium polystyrene sulfonate, ammonium polystyrene sulfonate, sodium polyisoprene sulfonate, ammonium polyisoprene sulfonate, sodium naphthalene sulfonate, ammonium naphthalene sulfonate, sodium salt of naphthalene sulfonic acid formaldehyde condensate, and ammonium salt of naphthalene sulfonic acid formaldehyde condensate; and dispersing agents formed of polyethylene glycol compounds. Non-aqueous dispersing agents include dispersing agents formed of acrylic compounds such as polyacrylates, polymethacrylates, polyacrylamide, and polymethacrylamide; dispersing agents formed of partial alkyl esters of polycarboxylic acids in which the polycarboxylic acids are partially esterified with alkyl groups; dispersing agents formed of polyether compounds; and dispersing agents formed of polyalkylene polyamine compounds.

As evident from this description, for instance, the concept of polycarboxylic acid-based compound encompasses polycarboxylic acid compounds and salts thereof. The same applies to other compounds as well.

A compound practically classified as an aqueous dispersing agent or a non-aqueous dispersing agent may be used as the opposite (as a non-aqueous dispersing agent or an aqueous dispersing agent) depending on a certain feature of its chemical structure or on the form of use.

Examples of the surfactant-based dispersing agent (or low molecular weight dispersing agent) include, as for the aqueous dispersing agent, dispersing agents formed of alkyl sulfonic acid-based compounds, dispersing agents formed of quaternary ammonium compounds, and dispersing agents formed of alkylene oxides. The non-aqueous dispersing agent include dispersing agents formed of polyol esters, dispersing agents formed of alkyl polyamines, and dispersing agents formed of imidazolines such as alkyl imidazolines.

Examples of the inorganic dispersing agent include, as for the aqueous dispersing agent, phosphates such as orthophosphates, metaphosphates, polyphosphates, pyrophosphates, tripolyphosphates, hexametaphosphates, and organophosphates; iron salts such as ferric sulfate, ferrous sulfate, ferric chloride, and ferrous chloride; aluminum salts such as aluminum sulfate, aluminum polychloride, and sodium aluminate; calcium salts such as calcium sulfate, calcium hydroxide, and dibasic calcium phosphate.

Among the dispersing agents, any one species can be used singly, or two or more species can be used in combination. A preferable embodiment of the art disclosed herein as a specific example involves a combined use of an alkyl imidazoline-based dispersing agent and a dispersing agent formed of a polyacrylic acid. The dispersing agent content is not necessarily limited as it also depends on the composition (physical properties), etc., of the thermal spray particles. In typical, it is roughly in a range of 0.01% to 10% by mass with the mass of the thermal spray particles being 100% by mass.

The thermal spray slurry can be prepared by mixing and dispersing thermal spray particles in the dispersion medium. The dispersion can be carried out with a homogenizer, mixer such as blade mixer, disperser, and the like.

The thermal spray slurry thus prepared is characterized by having a supply efficiency index If of 70% or higher when determined according to (1) to (3) described earlier.

The supply efficiency index enables assessment of the efficiency of supplying the thermal spray particles in the thermal spray slurry to a thermal sprayer.

The supply efficiency index If is defined with respect to 800 mL of the thermal spray slurry Thus, supply efficiency can be more adequately assessed with respect to the thermal spray slurry that may be used under various thermal spray conditions (e.g. under scaled-up thermal spray conditions). Furthermore, various design standards can be obtained to appropriately carry out thermal spraying under various thermal spray conditions.

When the supply speed is specified to be 35 mL/min in flow rate, a hard flow can be created in the thermal spray slurry being transported through a tube in the aforementioned dimensions. It is preferable to create such a hard flow because the supply efficiency of the slurry can be evaluated while the slurry is in a state with increased pushing force of the slurry and increased dispersity of the thermal spray particles. The material of the tube used in testing the supply efficiency is not strictly limited. To achieve conditions for smooth supply of the thermal spray slurry, it is preferable to use, for instance, a flexible tube made of a resin such as polyurethane, polyvinyl chloride, polytetrafluoroethylene, etc. To check how the thermal spray particles flow from the outside through the tube, a transparent or semi-transparent tube can be used as well.

In the art disclosed herein, the supply efficiency of thermal spray particles to a thermal sprayer can be judged sufficient when the supply efficiency index If is 70% or higher. The supply efficiency index If is preferably 75% or higher, more preferably 80% or higher, or yet more preferably 85% or higher, for instance, 90% or higher (ideally 100%). In the thermal spray slurry satisfying the supply efficiency index, precipitation of the thermal spray particles is reduced when the slurry is supplied to a thermal sprayer, whereby more thermal spray particles can be supplied to the thermal sprayer. In addition, it is unlikely to give rise to a difference in slurry concentration between an initial supply portion and a final supply portion of the thermal spray slurry. By this, the thermal spray particles can be supplied to thermal sprayers highly efficiently and stably, whereby a high-quality thermal spray coating can be formed.

The ratio of thermal spray particles in the thermal spray slurry as above is not particularly limited. For instance, the ratio of the thermal spray particles to the entire thermal spray slurry can be preferably 10% by mass or higher, or more preferably 15% by mass or higher, for example, 20% by mass or higher. With a 10% by mass or higher non-volatile content, the thickness of a thermal spray coating produced from the thermal spray slurry per unit time (i.e. the thermal spray efficiency) can be increased.

The ratio of the thermal spray particles in the thermal spray slurry can be 50% by mass or lower, or preferably 45% by mass or lower, for instance, 40% by mass or lower. With a 50% by mass or lower non-volatile content, suitable fluidity can be obtained for supplying the thermal spray slurry to a thermal sprayer.

The viscosity of the thermal spray slurry can be, but is not necessarily limited to, 1000 mPa·s or lower, preferably 500 mPa·s or lower, or more preferably 100 mPa·s or lower, for instance, 50 mPa·s or lower. With decreasing viscosity of the thermal spray slurry, the fluidity can be further increased.

The minimum viscosity of the thermal spray slurry is not particularly limited. Low viscosity of a thermal spray slurry may indicate a low thermal spray particle content. From such a standpoint, the viscosity of the thermal spray slurry is preferably, for instance, 0.1 mPa·s or higher. By adjusting the viscosity of the thermal spray slurry in these ranges, the supply efficiency index can be adjusted to be in a preferable range.

In the thermal spray slurry, the thermal spray particles preferably have an absolute zeta potential of 50 mV or lower. With the absolute zeta potential in the thermal spray slurry nearing 0 mV, the supply efficiency index can increase. The zeta potential of thermal spray particles can be measured by, for instance, electrophoresis, ultrasonic attenuation, electroacoustic methods, etc. Electrophoresis analysis can be conducted, using, for instance, ELS-Z available from Otsuka Electronics Co., Ltd.; ultrasonic attenuation analysis, using, for instance, DT 1200 available from Dispersion Technology Inc.; and electroacoustic analysis, using, for instance, ZETAPROB available from Colloidal Dynamics LLC.

The pH of the thermal spray slurry is preferably, but not particularly limited to, 2 or higher, but 12 or lower. In view of the ease of handling of the thermal spray slurry, the pH is preferably 6 or higher, but 8 or lower. On the other hand, for instance, to adjust the zeta potential of the thermal spray particles, etc., the pH may not be in the range of 6 or higher, but 8 or lower. For instance, it can be 7 or higher, but 11 or lower, or even 3 or higher, but 7 or lower.

The pH of the thermal spray slurry can be adjusted with various known acids, bases or their salts. In particular, it is preferable to use organic acids such as carboxylic acids, organophosphonic acids, and organosulfonic acids; inorganic acids such as phosphoric acid, phosphorous acid, sulfuric acid, nitric acid, hydrochloric acid, boric acid, and carbonic acid; organic bases such as tetramethylammonium hydroxide, trimethanolamine, and monoethanolamine; inorganic bases such as potassium hydroxide, sodium hydroxide and ammonia; or salts of these.

For the pH of the thermal spray slurry, the value measured based on JIS Z 8802:2011 can be used. The measurement value is obtained, using a glass electrode pH meter (e.g. a portable pH meter (F-72) available from Horiba, Ltd.), a pH standard solution (e.g. a phthalate pH standard solution (pH 4.005 at 25° C.), a neutral phosphate pH standard solution (pH 6.865 at 25° C.), and a carbonate pH standard solution (pH 10.012 at 25° C.).

In the thermal spray slurry, the thermal spray particles preferably form secondary particles. The supply efficiency index can be adjusted by adjusting the amount and the average particle diameter of the secondary particles formed of the thermal spray particles. The presence of secondary particles formed of the thermal spray particles can be determined, for instance, by whether or not the average particle diameter (D50) measured by a particle size analyzer based on laser diffraction/scattering spectroscopy is larger than the average primary particle diameter of the thermal spray particles before prepared into the thermal spray slurry. The average particle diameter of the secondary particles of the thermal spray particles formed in the thermal spray slurry is preferably 30 μm or smaller, more preferably 25 μm or smaller, or yet more preferably 15 μm or smaller. It can be determined also by finding out by how much the average particle diameter of the secondary particles of the thermal spray particles in the thermal spray slurry is greater than the average primary particle diameter of the thermal spray particles before prepared into the thermal spray slurry. For instance, the average particle diameter of the secondary particles of the thermal spray particles formed in the thermal spray slurry is preferably at least 1.2 times or more preferably at least 1.5 times the average primary particle diameter of the thermal spray particles before prepared into the thermal spray slurry (Other Optional Components)

The thermal spray slurry may comprise a viscosity-adjusting agent as necessary Here, the viscosity-adjusting agent refers to a compound capable of decreasing or increasing the viscosity of the thermal spray slurry. Suitable adjustment of the viscosity of the thermal spray slurry can reduce the lowering of the supply efficiency of the thermal spray slurry even when the thermal spray particle content in the thermal spray slurry is relatively high. Examples of a compound usable as the viscosity-adjusting agent include nonionic polymers including polyether such as polyethylene glycol, polyvinyl alcohols, polyvinylpyrrolidone, polyvinyl acetate, polyvinyl benzyl trimethyl ammonium chloride, aqueous urethane resins, gum Arabic, chitosan, cellulose, crystalline cellulose, methyl cellulose, ethyl cellulose, hydroxyethyl cellulose, carboxymethyl cellulose, carboxymethyl cellulose ammonium, carboxymethyl cellulose, carboxyvinyl polymer, lignosulfonates, and starch. The viscosity-adjusting agent content can be in a range of 0.01% to 10% by mass.

The thermal spray slurry may further comprise a coagulant (or a re-dispersion aid, anti-caking agent, etc.). Here, the coagulant refers to a compound capable of causing agglomeration of the thermal spray particles in the thermal spray slurry. It typically refers to a compound capable of causing flocculation of the thermal spray particles in the thermal spray slurry. Although the physical properties of the thermal spray particles can be factors as well, when the thermal spray slurry comprises a coagulant (including a re-dispersing aid, anti-caking agent, etc.), the coagulant is present between the thermal spray particles when they precipitate and thus rigid joining (aggregation) of the precipitated thermal spray particles is reduced and their re-dispersion is enhanced. In other words, it can prevent dense agglomeration (possibly aggregation; also caking or hard caking) of the precipitated thermal spray particles. Accordingly, when the slurry is transported to a thermal sprayer, etc., a hard flow occurring in the slurry can cause re-dispersion relatively easily to reduce precipitation during the transport and increase the supply efficiency to the thermal sprayer. When the thermal spray slurry is stored in a container, even if the long term storage causes precipitation of the thermal spray particles, they can be re-dispersed by a simple shaking operation such as vertical shaking of the container by hand, thereby increasing the supply efficiency to a thermal sprayer.

The coagulant or re-dispersing aid can be an aluminum-based compound, an iron-based compound, a phosphoric acid-based compound, or an organic compound. Examples of the aluminum-based compound include aluminum sulfate, aluminum chloride, and polyaluminum chloride (or PAC, PACl). Examples of the iron-based compound include ferric chloride and polyferric sulfate. Examples of the phosphoric acid-based compound include sodium pyrophosphate. Examples of the organic compound can be anionic, cationic or nonionic, including organic acids such as malic acid, succinic acid, citric acid, maleic acid, and maleic acid anhydride as well as diallyl dimethyl ammonium chloride polymer, lauryl trimethyl ammonium chloride, naphthalene sulfonic acid condensate, sodium triisopropyl naphthalene sulfonate, sodium polystyrene sulfonate, isobutylene-maleic acid copolymer, and carboxyvinyl polymer.

The thermal spray slurry may further comprise an anti-foaming agent. Here, the anti-foaming agent refers to a compound capable of preventing foaming in the thermal spray slurry when the thermal spray slurry is being produced or in the process of thermal spraying, or a compound capable of dissipating foam formed in the thermal spray slurry. Examples of the anti-foaming agent include silicone oil, silicone emulsion-based anti-foaming agents, polyether-based anti-foaming agents, and aliphatic acid ester-based anti-foaming agents.

The thermal spray slurry may further comprise additives such as a preservative, antifungal agent, and antifreeze. Examples of the preservative or antifungal agent include isothiazoline-based compounds, azole-based compounds, and propylene glycol. Examples of the antifreeze include polyols such as ethylene glycol, diethylene glycol, propylene glycol, and glycerin.

When using additives such as the dispersing agent, viscosity-adjusting agent, coagulant, re-dispersing aid, anti-foaming agent, antifreeze, preservative and antifungal agent as optional components, in preparing the thermal spray slurry, these additives can be added to the dispersion medium at the same time with the thermal spray particles or separately at an arbitrary time.

The compounds as the various additives exemplified above may show other functionalities as additives besides the effects of the additives for their main purposes of use. In other words, for instance, even if a compound is of the same type or formula, it may occasionally show effects as two or more different additives.

[Thermal Spray Slurry Prep Material]

As described above, with the thermal spray slurry disclosed herein, even if the thermal spray particles precipitate, suitable re-dispersion can be obtained by a dispersing process such as shaking or stirring it again, etc. Thus, the thermal spray slurry with precipitated thermal spray particles can be divided in advance into a portion (typically the supernatant) with no or low thermal spray particle content and a portion (typically the residue left after removal of the supernatant) with all or much of the thermal spray particle content; the two portions can be suitably mixed and subjected to a shaking process, etc., to obtain the thermal spray slurry. Furthermore, the components of the thermal spray slurry can be separately obtained in several portions; these can be suitably mixed and subjected to a shaking process, etc., to obtain the thermal spray slurry. Accordingly, the thermal spray slurry can be prepared, for instance, as follows: the respective components of the thermal spray slurry are placed in separate containers individually or as mixtures of two or more different components, and these are combined into one mixture before subjected to thermal spraying.

From such a standpoint, the art disclosed herein provides a thermal spray slurry prep material used for preparing the thermal spray slurry. The prep material comprises at least one component of the thermal spray slurry. It is formulated to satisfy the supply efficiency index If of 70% or higher when all the components of the thermal spray slurry are mixed into one mixture.

The prep material can be solely part of the components of the thermal spray slurry. A prep material A may be combined with another prep material B or with two or more prep materials B, C, and so on so that all the components of the thermal spray slurry are included. With respect to the thermal spray slurry, for instance, when separated into the thermal spray particles and the dispersion medium, their volume ratio is in the following relationship: (Volume (mL) of A kg of thermal spray particles)/(800−Volume (mL) of A kg of thermal spray particles). Similarly, the weight ratio of the thermal spray particles to the dispersion medium can be determined as well. These volume ratio and weight ratio may vary in certain ranges as long as the supply efficiency index If is 70% or higher. Thus, when the prep material consists of part of the components, the other components necessary to obtain the thermal spray slurry disclosed herein and their amounts (e.g. weights or volumes) can be determined. In addition to the thermal spray particles and the dispersion medium, the components of the thermal spray slurry can include optional components (additives) such as the aforementioned dispersing agent and viscosity-adjusting agent. Specific examples of combinations of components for such prep materials include the following:

Example 1

Prep material A1: thermal spray particles
Prep material B1: dispersion medium

Example 2

Prep material A2: thermal spray particles and part of dispersion medium
Prep material B2: rest of dispersion medium Example 3

Prep material A3: thermal spray particles
Prep material B3: dispersion medium and optional component(s) (additive(s))

Example 4

Prep material A4: thermal spray particles
Prep material B4: dispersion medium
Prep material C4: optional component(s) (additive(s))

Here, with respect to the prep material C4, when several optional components are used, for instance, a prep material C4n (n=1, 2 . . . ) may be individually formulated for every optional component.

The thermal spray slurry prep material disclosed herein can be divided in separate packages of the respective components of the thermal spray slurry such as the thermal spray particles, dispersion medium, dispersing agent and other optional components; or can be divided in separate packages of mixtures, with each mixture containing two or more species. The thermal spray slurry prep material can be mixed before subjected to thermal spraying with other component(s) (possibly other thermal spray slurry prep material(s)) to prepare the thermal spray slurry. From the standpoint of the ease of transport, the components excluding the dispersion medium can be packed as one thermal spray slurry prep material and the dispersion medium can be packed as another thermal spray slurry prep material. Alternatively, for instance, the other components (thermal spray particles and optional components such as additives) besides the dispersion medium can be in the powder (solid) forms. It is noted that, for instance, when the dispersion medium is formed of readily available material(s), users of the thermal spray slurry may obtain the dispersion medium on their own. In view of the uniformity of the thermal spray slurry or the stable performance of the coating, it is preferable to prepare the thermal spray slurry as a highly concentrated slurry with more concentrated thermal spray particles.

The thermal spray slurry prep material above may include information regarding the preparation of the thermal spray slurry. The information can describe a method for preparing the thermal spray slurry using the thermal spray slurry prep material. For instance, it shows the amounts (volumes or weights) of the separately packed components and the procedures for mixing them as well as information related to the materials, etc., required besides the thermal spray slurry prep material. While the thermal spray slurry prep material is formulated to give a supply efficiency index If of 70% or higher, it may show information regarding how the If value can be further increased. Such information can be displayed on the containers of the respective components or on the outer packages of these containers. Alternatively, document paper, etc., with the information may be preset (included) with the containers of the respective components. The information may be made available on the internet, etc., for users who obtain the thermal spray slurry prep material. By this, using the thermal spray slurry prep material disclosed herein, a thermal spray coating can be formed more easily, certainly, and highly efficiently.

[Method for Forming a Coating]

(Substrate)

In the thermal spray coating formation method disclosed herein, the substrate provided with thermal spray coating is not particularly limited. For instance, substrates formed of various materials can be used if the materials forming the substrates are proofed as desired for such thermal spraying. Examples of the materials include various metals and alloys. Specific examples include aluminum, aluminum alloys, iron, steel, copper, copper alloys, nickel, nickel alloys, gold, silver, bismuth, manganese, zinc, and zinc alloys. Among them, favorable examples include a substrate formed of a widely-used metallic material with a relatively large thermal expansion coefficient, such as steels typified by various SUS materials (possibly so-called stainless steels), heat-resistant alloys typified by Inconel, erosion-resistant alloys typified by Hastelloy, and aluminum alloys typified by 1000-series to 7000-series aluminum alloys useful as lightweight structural materials, etc.

(Method for Forming a Coating)

The thermal spray slurry disclosed herein can be used as a thermal spray material for forming a thermal spray coating by subjecting it to a thermal sprayer based on a known thermal spraying method. In the thermal spray slurry, typically when left standing for a certain period of time for storage and like purpose, the thermal spray particles may start to settle and precipitate in the dispersion medium. Thus, the thermal spray slurry in the art disclosed herein should be prepared so that the supply efficiency index If is 70% or higher at the time of being subjected to thermal spraying (e.g. in a step of prepping for a supply to a thermal sprayer). For instance, the stored thermal spray slurry (which can be referred to as the slurry precursor) before subjected to thermal spraying can be prepared, for instance, as a highly concentrated slurry with more concentrated thermal spray particles.

Examples of favorable thermal spray methods for the thermal spray slurry include plasma spraying and high velocity flame spraying.

In the plasma spraying, a plasma flame is used as the thermal spray heat source to soften or melt the thermal spray material. An arc is generated between electrodes to form a plasma from a working gas and the plasma stream is emitted through a nozzle as a high-temperature high velocity plasma jet. The plasma spraying encompasses general coating methods where a thermal spray material is subjected to the plasma jet, heated, accelerated, and deposited on a substrate to obtain a thermal spray coating. The plasma spraying can be in embodiments of atmospheric plasma spraying (APS) carried out in the air, low pressure plasma spraying (LPS) carried out at a pressure lower than the atmospheric pressure, high pressure plasma spraying carried out in a chamber pressurized higher than the atmospheric pressure, and so on. According to the plasma spraying, for instance, by melting and accelerating the thermal spray material with a plasma jet at about 5000° C. to 10000° C., the thermal spray particles are allowed to collide at a speed of about 300 m/s to 600 m/s with a substrate and accumulated thereon.

The high velocity flame spraying can be, for instance, high velocity oxygen fuel spraying (HVOF), warm spraying, high velocity air fuel spraying (HVAF), etc.

HVOF is a type of flame spraying that uses, as the thermal spray heat source, a burning flame formed by high-pressure combustion of a fuel/oxygen mixture. The combustion chamber is pressurized so that a high-velocity (possibly ultrasonic) high-temperature gas stream is emitted through a nozzle as a continuously burning flame. HVOF encompasses general coating methods where a thermal spray material is subjected to the gas stream, heated, accelerated, and deposited on a substrate to obtain a thermal spray coating. According to HVOF, for instance, the thermal spray slurry is subjected to an ultrasonic burning flame jet at 2000° C. to 3000° C. to remove (possibly by combustion or evaporation; the same applies hereinafter) the dispersion medium from the slurry and also to soften or melt the thermal spray particles so that they are allowed to collide at a speed as high as 500 m/s to 1000 m/s with a substrate and accumulated thereon. The fuel used in high velocity flame spraying can be hydrocarbon fuel gases such as acetylene, ethylene, propane, and propylene or liquid fuels such as kerosene and ethanol. With increasing melting point of the thermal spray material, it is preferable that the ultrasonic burning flame has a higher temperature. From this standpoint, a fuel gas is preferably used.

Alternatively, so-called warm spraying as an application of HVOF can be employed as well. In warm spraying, typically, thermal spraying is carried out at a lower flame temperature, for instance, by mixing a cooling gas formed of nitrogen or the like around room temperature into the burning flame of HVOF. The thermal spray material is not limited to a completely melted state. For instance, thermal spraying can be carried out with a material that is partially melted or in a partially softened state at or below its melting point. According to the warm spraying, for instance, the thermal spray slurry is subjected to an ultrasonic burning flame jet at 1000° C. to 2000° C. to remove (possibly by combustion or evaporation; the same applies hereinafter) the dispersion medium from the slurry and also to soften or melt the thermal spray particles so that they are allowed to collide at a speed as high as 500 m/s to 1000 m/s with a substrate and accumulated thereon.

HVAF is a thermal spray method that uses air in place of oxygen as the combustion supporter gas in HVOF. In HVAF, thermal spraying can be carried out at a lower temperature as compared to HVOF. For instance, the thermal spray slurry is subjected to an ultrasonic burning flame jet at 1600° C. to 2000° C. to remove (possibly by combustion or evaporation; the same applies hereinafter) the dispersion medium from the slurry and also to soften or melt the thermal spray particles so that they are allowed to collide at a speed as high as 500 m/s to 1000 m/s with a substrate and accumulated thereon.

The invention disclosed herein is preferable because, in high velocity flame spraying or plasma spraying of the thermal spray slurry, even if it comprises a thermal spray material with relatively large particle diameters, the thermal spray material can be sufficiently softened or melted; and even if the thermal spray slurry has a high thermal spray particle content, thermal spraying can be carried out with great fluidity to efficiently form a dense thermal spray coating.

Although the way of supplying the thermal spray slurry to a thermal sprayer is not particularly limited, the flow rate is preferably 10 mL/min or higher, but 200 mL/min or lower. When the supply rate of the thermal spray slurry is about 10 mL/min or higher, a hard flow can be generated in the thermal spray slurry being transported through a thermal spray slurry supply system (e.g. a slurry supply tube) to preferably increase the pushing force of the slurry and reduce precipitation of the thermal spray particles. From such a standpoint, when supplying the thermal spray slurry, the flow rate is preferably 20 mL/min or higher, or more preferably 30 mL or higher. On the other hand, at an excessively high supply rate, it may unfavorably exceed the amount of slurry allowed for thermal spraying by the thermal sprayer. From such a standpoint, the flow rate for supplying the thermal spray slurry is suitably 200 mL/min or lower, preferably 150 mL/min or lower, for instance, 100 mL/min or lower.

The thermal spray slurry is preferably supplied to a thermal sprayer in an axial feed mode, that is, in the same direction as the axis of the jet stream formed in the thermal sprayer. For instance, it is preferable to supply the thermal spray slurry of the embodiment of the present invention to a thermal sprayer in an axial feed mode because, for instance, the thermal spray slurry is highly fluid and the thermal spray material in the thermal spray slurry is less likely to accumulate in the thermal sprayer, whereby a dense thermal spray coating can be efficiently formed.

When the thermal spray slurry is supplied with a general feeder to a thermal sprayer, it may be difficult to stabilize the supply because of periodic changes in supply amount. When the supply amount of the thermal spray slurry becomes inconsistent due to the periodic changes in supply amount, it may be difficult to evenly heat the thermal spray material in the thermal sprayer and an uneven thermal spray coating may be formed. Thus, to stably supply the thermal spray slurry to a thermal sprayer, a two-stroke mode (i.e. two feeders) may be used to supply the thermal spray slurry, with the two feeders supplying the thermal spray slurry in amounts (at rates) changing in oppositely-phased cycles. In particular, for instance, the supply system can be adjusted to have supply cycles such that one feeder is in a period of increasing supply amount while the other feeder is in a period of decreasing supply amount. When the thermal spray slurry of this invention is supplied to a thermal sprayer in the two-stroke mode, because of the great fluidity of the thermal spray slurry, a dense thermal spray coating can be efficiently formed.

As for means of stably supplying the thermal spray material in a slurry form to a thermal sprayer, the slurry released from feeders may be temporarily stored in a tank placed just before the thermal sprayer and supplied to the thermal sprayer by natural falling, or the slurry in the tank may be forcibly supplied by means such as a pump to the thermal sprayer. The forcible supply by means such as a pump is preferable because, even if the tank and the thermal sprayer are connected with a tube, the thermal spray material in the slurry is less likely to accumulate in the tube. To obtain a uniform distribution of the components in the thermal spray slurry in the tank, a means to stir the thermal spray slurry in the tank may be included.

The thermal spray slurry is preferably supplied to a thermal sprayer, for instance, through a conductive metal tube. The use of a conductive tube inhibits generation of static charges, leading to fewer changes in supply amount of the thermal spray slurry. The interior of the conductive tube preferably has a surface roughness Ra of 0.2 μm or less.

A preferable spray distance is 30 mm or greater from the nozzle tip of the thermal sprayer to the substrate. An excessively short spray distance is not preferable because there may not be enough time for removing the dispersion medium from the thermal spray slurry or for softening or melting the thermal spray particles or because the substrate may be altered or deformed by the thermal spray heat source near the substrate.

The spray distance is preferably about 200 mm or less (more preferably 150 mm or less, e.g. 100 mm or less). At such a distance, sufficiently heated thermal spray particles can reach the substrate while maintaining the temperature, whereby a denser thermal spray coating can be obtained.

During the thermal spraying process, it is preferable to cool the substrate surface opposite from the sprayed surface. The cooling can be achieved with water or other suitable coolants.

(Thermal Spray Coating)

By the art disclosed hereinabove, a thermal spray coating is formed from a thermal spray material having a desirable composition to form thermal spray particles.

As described above, the thermal spray coating is formed with a thermal spray slurry that can be supplied suitably with a supply efficiency index If of 70% or higher. Thus, the thermal spray particles stay suitably dispersed in a fluid state in the thermal spray slurry and stably supplied to a thermal sprayer to form a thermal spray coating. The thermal spray particles are efficiently supplied to the vicinity of the center of the heat source without getting blown off by the flame or jet stream and can be sufficiently softened or melted. Therefore, the softened or melted thermal spray particles adhere tightly to a substrate or to each other. By this, a thermal spray coating with uniform quality and appropriate adhesion is formed at a favorable coating speed.

Several Examples related to the present invention are described below, but the present invention is not to be limited to these Examples.

[Preparation of Thermal Spray Slurry]

As for the thermal spray particles, were obtained yttria ($Y_2O_3$), alumina ($Al_2O_3$), hydroxyapatite ($Ca_{10}(Po_4)_6(OH)_2$, and copper (Cu) powders having the average primary particle diameters shown in Table 1 below. Table 1 also shows the results of specific gravity and specific surface area measurements of these thermal spray particles.

As described earlier, the average particle diameter of thermal spray particles as small as less than 1 μm is the equivalent spherical diameter determined from the specific surface area of the thermal spray particles measured using a dynamic flow surface area analyzer FLOWSORB II 2300 available from Micromeritics. With respect to thermal spray particles of 1 μm or larger, the average particle diameter is the value determined with a laser diffraction/scattering particle size analyzer (LA-950 available from Horiba, Ltd.). The specific gravities of the thermal spray particles are the values determined based on the methods of measuring density and specific gravity of liquid specified in JIS Z 8804:2012.

As the dispersion media, were obtained distilled water as an aqueous dispersion medium and a solvent mixture containing ethanol (EtOH), isopropanol (i-PrOH) and normal propanol (n-PrOH) at 85:5:10 (volume ratio) as a non-aqueous dispersion medium. As for additives as optional components, were obtained the dispersing agents (alkyl imidazoline and aqueous polycarboxylic acid polymer dispersing agents) and the viscosity-adjusting agent (polyethylene glycol) shown in Table 1 below. The thermal spray particles and dispersion medium were obtained in different containers to yield a 30% (by mass) thermal spray particle content.

The thermal spray particles and the dispersion media were mixed along with the dispersing agents and viscosity-adjusting agent at ratios shown in Table 1 below to prepare thermal spray slurries 1 to 12. In these embodiments, the dispersing agents were used in amounts suitably adjusted in accordance with the dispersion states of the thermal spray particles in the thermal spray slurries. The amount of viscosity-adjusting agent used was fixed to a constant level, namely 0.1% by mass. In Table 1, "–" in the column headed "Viscosity-adjusting agent" indicates non-use.

[Presence of Secondary Particles]

With respect to the thermal spray particles in the respective thermal spray slurries obtained, the average particle diameters were determined using a laser diffraction/scattering particle size analyzer (LA-950 available from Horiba, Ltd.). In comparison of the average particle diameters of the thermal spray particles obtained for the preparation of the thermal spray slurries against the average particle diameters of the thermal spray particles in the slurries, when the average particle diameter of the thermal spray particles in a slurry was 1.5-fold or larger, it was determined that the thermal spray particles had agglomerated in the slurry to form secondary particles. With respect to an example judged to have secondary particles formed of the thermal spray particles, "Present" is shown in the cell headed "Secondary particles"; with respect to an example judged to be free of secondary particles, "Absent" is shown.

[Viscosity]

With respect to the thermal spray slurries obtained, the viscosity was measured at room temperature (25° C.) at a rotational speed of 62.5 rpm, using a viscometer (VISCOTESTER VT-03F available from Rion Co., Ltd). The results are shown in Table 1.

[Zeta Potential]

With respect to the thermal spray particles in the respective thermal spray slurries obtained, the zeta potentials were measured using an ultrasonic particle size/zeta potential meter (DT-1200 available from Dispersion Technology Inc.). The zeta potentials of the thermal spray particles in the respective examples were divided into two ranges, namely 50 mV or lower and 100 mV or higher. Accordingly, the measurement results are shown as "≤50" or "≥100" in Table 1.

[Supply Efficiency Index If]

With respect to each thermal spray slurry obtained, the supply efficiency index If was determined in the following procedures: a 5 m long polyurethane tube (touch tube (urethane) TE-8 available from Chiyoda Tsusho Co., Ltd.; 8 mm outer diameter×5 mm inner diameter) was horizontally placed on a levelled test board; a roller pump was attached to one end of the tube for the supply of slurry and a slurry-collecting container to the other end; the thermal spray slurry obtained was stirred with a magnetic stirrer to confirm that the thermal spray particles were well dispersed and the slurry was then supplied into the tube at a flow rate of 35 mL/min; subsequently, the thermal spray slurry passed through the tube was collected into a container and the mass B of the thermal spray particles in the collected slurry was determined; from the mass A of the thermal spray particles in 800 mL of the thermal spray slurry which had been determined in advance after its preparation and the mass B of the thermal spray particles in the collected slurry, the supply efficiency index If was determined based on the next equation:

$$If(\%)=B/A\times 100$$

The results are shown in Table 1.

[Formation of Thermal Spray Coating]

Using the respective thermal spray slurries obtained above, thermal spray coatings were formed by atmospheric plasma spraying (APS) under the following thermal spray conditions.

As the substrate to be sprayed, an SS400 steel plate (70 mm×50 mm×2.3 mm) was obtained and used after the surface was roughened. APS was carried out, using a commercial plasma sprayer (SG-100 available from Praxair Technology, Inc.). With respect to the plasma-forming conditions, at the atmospheric pressure, argon and helium were supplied as plasma-forming gases at 100 psi and 90 psi, respectively, and the plasma-forming power was set to 40 kW. Using a slurry supply system, the thermal spray slurry was supplied to the burner chamber of the thermal sprayer at a supply rate of about 100 mL/min. For supplying the slurry to the thermal sprayer, a tank was placed right by the thermal sprayer and the prepared thermal spray slurry was stored temporarily in the tank and supplied to the thermal sprayer by allowing the slurry to naturally fall. By this, while the plasma jet was emitted through the thermal sprayer's nozzle and the thermal spray slurry supplied to the burner chamber was allowed to travel through the air on the jet stream, the dispersion medium was removed from the slurry and the thermal spray particles were melted and sprayed on the substrate to form a coating thereon. The spray gun was moved at a speed of 600 mm/min and the spray distance was set to 50 mm.

[Efficiency of Coating]

The efficiency of coating (efficiency of deposition) of the thermal spray particles was evaluated when the coating was formed by subjecting the thermal spray slurry of each example to thermal spraying. In particular, it shows the measured thickness (μm) of the thermal spray coating formed in one pass (a single application of thermal spray from the thermal sprayer to the substrate) under the thermal spray conditions described above.

TABLE 1

| | Thermal spray particles | | | | Specific | Additives | | |
|---|---|---|---|---|---|---|---|---|
| | | Average particle | Dis- | Specific gravity | surface area | Dispersing agent | | Viscosity-adjusting |
| Ex. | Composition | diameter (μm) | persion media | (Particles) | (Particles) | Species | Amount (mass %) | agent Species |
| 1 | $Y_2O_3$ | 6 | EtOH + i-PrOH + n-PrOH | 1.3 | 2.51 | Alkyl imidazoline | 0.21 | — |

TABLE 1-continued

| | | | | | | | | |
|---|---|---|---|---|---|---|---|---|
| 2 | $Y_2O_3$ | 6 | Water | 1.3 | 2.51 | Aq. polymer dispersing agent | 8.69 | Polyethylene glycol |
| 3 | $Y_2O_3$ | 3 | Water | 1.3 | 3.42 | Aq. polymer dispersing agent | 0.05 | — |
| 4 | $Y_2O_3$ | 3 | Water | 1.3 | 3.42 | Aq. polymer dispersing agent | 0.05 | Polyethylene glycol |
| 5 | $Y_2O_3$ | 1.6 | EtOH + i-PrOH + n-PrOH | 1.3 | 3.86 | Alkyl imidazoline | 0.20 | — |
| 6 | $Y_2O_3$ | 1.6 | EtOH + i-PrOH + n-PrOH | 1.3 | 3.86 | Alkyl imidazoline | 4.83 | Polyethylene glycol |
| 7 | $Y_2O_3$ | 0.01 | Water | 1.3 | 40 | Aq. polymer dispersing agent | 0.05 | Polyethylene glycol |
| 8 | $Al_2O_3$ | 10 | Water | 1.3 | 1.26 | Aq. polymer dispersing agent | 0.05 | Polyethylene glycol |
| 9 | $Al_2O_3$ | 6 | Water | 1.3 | 2.15 | Aq. polymer dispersing agent | 0.05 | — |
| 10 | $Al_2O_3$ | 6 | Water | 1.3 | 2.15 | Aq. polymer dispersing agent | 0.05 | Polyethylene glycol |
| 11 | Hydroxy-apatite | 6 | Water | 0.7 | 6.2 | Aq. polymer dispersing agent | 0.05 | Polyethylene glycol |
| 12 | Cu | 3 | EtOH + i-PrOH + n-PrOH | 2.4 | 0.58 | Alkyl imidazoline | 4.83 | Polyethylene glycol |

| | Characteristics of slurry | | | | Supply efficiency of slurry | | | Coating |
|---|---|---|---|---|---|---|---|---|
| Ex. | Secondary particles | Viscosity (mPa · s) | pH | Zeta potential (mV) | Amount of thermal spray particles before supplied A (kg/800 ml) | Amount of thermal spray particles collected B (kg/800 ml) | If (%) | efficiency (μm) |
| 1 | Absent | 2 | 11.2 | ≥100 | 0.252 | 0.136 | 54.0 | 1.5 |
| 2 | Present | 50 | 10.2 | ≤50 | 0.309 | 0.296 | 95.8 | 3.2 |
| 3 | Absent | 2 | 10.1 | ≥100 | 0.309 | 0.226 | 73.3 | 1.9 |
| 4 | Present | 15 | 10.3 | ≤50 | 0.309 | 0.283 | 91.7 | 3.0 |
| 5 | Absent | 2 | 9.5 | ≥100 | 0.252 | 0.204 | 81.0 | 2.4 |
| 6 | Present | 15 | 9.7 | ≤50 | 0.252 | 0.228 | 90.5 | 3.5 |
| 7 | Present | 125 | 10.7 | ≤50 | 0.303 | 0.294 | 97.0 | 2.0 |
| 8 | Present | 15 | 6.3 | ≤50 | 0.302 | 0.261 | 86.4 | 3.7 |
| 9 | Absent | 2 | 5.8 | ≥100 | 0.309 | 0.176 | 57.0 | 1.2 |
| 10 | Present | 15 | 5.9 | ≤50 | 0.309 | 0.286 | 92.6 | 2.9 |
| 11 | Present | 15 | 8.2 | ≤50 | 0.315 | 0.286 | 90.8 | 3.1 |
| 12 | Present | 15 | | ≤50 | 0.312 | 0.274 | 87.8 | 2.7 |

As shown in Table 1, in Examples 2 to 8 and 10 to 12, thermal spray slurries were obtained as disclosed herein, having supply efficiency indices If of 70% or higher.

In the thermal spray slurry of Example 1, yttria was used as the thermal spray particles, and as in the other examples, it was prepared to have a thermal spray particle concentration of 30% by mass. In Example 1, the thermal spray particles precipitated in the tube in the measurement of the supply efficiency index It while the tube was not clogged up, it was found that the thermal spray particles precipitated to a thickness equal to about one-fifth of the tube cross section. In addition, during the thermal spraying, precipitation (adhesion) of the thermal spray particles from the slurry were found in the slurry supply path of the thermal sprayer, resulting in low coaling efficiency, similarly to the low supply efficiency index If.

In comparison with the slurry of Example 1, in the thermal spray slurry of Example 2, the dispersion medium and the amounts of dispersing agent and viscosity-adjusting agent were changed to increase the viscosity of the slurry and adjust the zeta potential to be ≤50 mV for the thermal spray particles in the slurry. By this, the supply efficiency index If was as high as 95.8%. In the actual thermal spraying process, it was found that almost all of the thermal spray particles used in the slurry preparation were fed into the thermal sprayer and stably supplied to the flame. As a result, the coating efficiency was more than twice that of Example 1 and a significantly thicker thermal spray coating was formed per pass.

When compared to the slurry of Example 1, the thermal spray slurry of Example 3 showed comparable slurry characteristics, but thermal spray particles with larger particle diameters were used and the species of additive was changed. By this, the supply efficiency index If was above 70% and the slurry was stably supplied to the flame.

The thermal spray slurry of Example 4 was obtained by adding a viscosity-adjusting agent to the slurry of Example 3. By this, the thermal spray particles formed secondary particles in the slurry, whereby the slurry viscosity was increased and the zeta potential of the thermal spray particles in the slurry was adjusted to ≤50 mV. As a result, the supply efficiency index If was 91.7%, exceeding 90%, and the supply efficiency of the slurry significantly increased.

When compared to the slurry of Example 1, in the thermal spray slurry of Example 5, the thermal spray particles used had yet smaller particle diameters. No significant changes were found in viscosity of the slurry or in zeta potential of the thermal spray particles. However, because of the well-dispersed state of the fine thermal spray particles with an average particle diameter of 1.6 μm, the supply efficiency index If was 81.0%, exceeding 80%, indicating that the supply efficiency of the slurry was relatively good.

The thermal spray slurry of Example 6 was obtained by increasing the amount of dispersing agent from that in the slurry of Example 5 and further adding a viscosity-adjusting agent, whereby the viscosity of the slurry was increased and the zeta potential of the thermal spray particles in the slurry was adjusted to ≤50 mV. By this, the supply efficiency index If was 90.5% with an increase of about 10% when compared to that of Example 5, and also the coating efficiency increased by about 1.5-fold.

In comparison to the slurry of Example 4, with respect to the thermal spray slurry of Example 7, the average particle diameter of the thermal spray particles in the slurry was significantly smaller and the specific surface area of the thermal spray particles and the viscosity of the slurry were increased. However, the thermal spray particles in the slurry were as stable as in Example 4 and the supply efficiency index If was as high as 97.0%. In addition, despite of the use of ultrafine thermal spray particles with an average particle diameter of 0.01 μm, high coating efficiency was obtained.

In the thermal spray slurries of Examples 8 to 10, alumina was used as the thermal spray particles. With respect to the thermal spray slurry of Example 9, the thermal spray particles precipitated in the tube in the measurement of supply efficiency index If. While the tube was not clogged up, a large amount of the thermal spray particles was found as precipitates in the tube. In addition, during the thermal spraying, precipitation (adhesion) of the thermal spray particles in the slurry were found in the slurry supply path of the thermal sprayer, resulting in low coating efficiency, similarly to the low supply efficiency index If.

The thermal spray slurry of Example 10 was prepared by adding a viscosity-adjusting agent to the slurry of Example 9, whereby the slurry viscosity was increased and the zeta potential of the thermal spray particles in the slurry was further lowered. As a result, because of the viscosity-adjusting agent used together, the supply efficiency index If of the slurry of Example 10 was 92.6% showing a significant increase as compared to 57.0% of Example 7. Along with this, the coating efficiency also increased by about 2.5-fold.

The thermal spray slurry of Example 8 was obtained by adding a viscosity-adjusting agent to Example 9, with the thermal spray particles having a larger average particle diameter than Examples 9 and 10. The thermal spray particles in the slurry were as highly stable as in Example 10 and both the supply efficiency index If and coating efficiency of the slurry showed good values.

The thermal spray slurry of Example 11 used hydroxyapatite with a relatively small specific gravity. When thermal spray particles have a small specific gravity, the specific surface area increases and the viscosity is likely to increase. However, with respect to the thermal spray slurry of Example 11, an excessive increase in viscosity was inhibited because of the viscosity-adjusting agent added. As a result, the slurry was obtained with good fluidity and coating efficiency, having a high supply efficiency index If.

In the thermal spray slurry of Example 12, a metal (copper) powder with a relatively large specific gravity was used. Thermal spray particles with a large specific gravity are likely to precipitate in slurry. Because they are a metal powder, the viscosity of the slurry is unlikely to increase and the supply efficiency index If tends to be extremely small. However, with respect to the thermal spray slurry of Example 12, because of the dispersing agent and viscosity-adjusting agent added, appropriate viscosity and zeta potential were realized and the slurry was obtained, having a high supply efficiency index If as well as great fluidity and coating efficiency.

With respect to the thermal spray slurries above, regardless of the types (compositions (formulas), specific gravities) of the thermal spray particles, when the thermal spray slurries had zeta potentials adjusted to or below 50 mV and further had secondary particles formed therein, there were apparent tendencies to higher supply efficiency indices If with great coating efficiency. Thus, even if the thermal spray particles are susceptible to precipitation, by allowing the particles to form loose agglomerates to adjust the zeta potential to or below 50 mV, the stability of the thermal spray particles can be increased in the thermal spray slurry. As a result, clogging of thermal spray particles in thermal sprayers and tubes is less likely to occur and a highly fluid thermal spray slurry can be obtained.

From the above, it has been shown that by using the supply efficiency index If disclosed herein, supply efficiency to thermal sprayers can be easily evaluated with respect to thermal spray slurries that use thermal spray particles having various compositions and forms. It has been also shown that when the supply efficiency index is 70% or higher, regardless of the physical properties of the thermal spray particles, the slurry can be judged to have great supply efficiency. By using the supply efficiency index If, slurries can be prepared in states better suited for thermal spraying without, for instance, wasting a large amount of a slurry prep material. It has been also found that, by using such a thermal spray slurry, a thermal spray coating can be formed highly efficiently.

Although specific embodiments of the present invention have been described in detail above, these are merely for illustrations and do not limit the scope of claims. The art according to the claims includes various modifications and changes made to the specific embodiments illustrated above. For instance, in the embodiment described above, the amounts of the dispersing agent and viscosity-adjusting agent were adjusted in accordance with the dispersion state of the thermal spray particles in the thermal spray slurries. However, additives can be obtained in separate packages containing appropriate amounts thereof to give an If value of 70% or higher.

The invention claimed is:

1. A thermal spray slurry comprising:

a dispersion medium;

a dispersing agent; and thermal spray particles formed of at least one material selected from the group consisting of a ceramic, a cermet, and a metal, wherein:

the ceramic is an oxide-based ceramic, carbide-based ceramic, nitride-based ceramic, or boride-based ceramic;

the dispersion medium comprises water and/or at least one organic solvent;

800 mL of the thermal spray slurry contains A kg of the thermal spray particles;

when 800 mL of the thermal spray slurry in which the thermal spray particles are dispersed is supplied at a flow rate of 35 mL/min to a horizontally-placed tube and collected, the collected slurry contains B kg of the thermal spray particles; and the slurry has a supply efficiency index If of 70% or higher, determined by the next equation If (%)=B/A×100.

2. The thermal spray slurry according to claim 1 wherein the thermal spray particle content is 10% by weight or higher, but 50% by weight or lower.

3. The thermal spray slurry according to claim 1 wherein the thermal spray particles have an average particle diameter of 0.01 μm or larger, but 10 μm or smaller.

4. The thermal spray slurry according to claim 1 having a viscosity of 1000 MPa·s or lower.

5. The thermal spray slurry according to claim 1 wherein the dispersion medium is an aqueous dispersion medium.

6. The thermal spray slurry according to claim 1 wherein the dispersion medium is a non-aqueous dispersion medium.

7. A thermal spray slurry prep material used for preparing a thermal spray slurry, wherein:

the thermal spray slurry comprises, as components: a dispersion medium comprising water and/or at least one organic solvent; a dispersing agent; and thermal spray particles formed of at least one species of material selected from the group consisting of a ceramic, a cermet, and a metal;

the ceramic is an oxide-based ceramic, carbide-based ceramic, nitride-based ceramic, or boride-based ceramic;

800 mL of the thermal spray slurry contains A kg of the thermal spray particles;

when 800 mL of the thermal spray slurry in which the thermal spray particles are dispersed is supplied at a flow rate of 35 mL/min to a horizontally-placed tube and collected, the collected slurry contains B kg of the thermal spray particles;

the slurry has a supply efficiency index If of 70% or higher, determined by the next equation If (%)=B/A×100; and the slurry prep material comprises the thermal spray particles, at least a portion of the dispersion medium, and the dispersing agent.

8. The thermal spray slurry prep material according to claim 7 further comprising information regarding preparation of the thermal spray slurry.

* * * * *